US006617091B2

(12) United States Patent
Nishimori et al.

(10) Patent No.: US 6,617,091 B2
(45) Date of Patent: Sep. 9, 2003

(54) PRODUCTION METHOD OF TONER

(75) Inventors: Yoshiki Nishimori, Hachioji (JP); Takao Yamanouchi, Hachioji (JP); Shigenori Kohno, Hachioji (JP); Meizo Shirose, Hachioji (JP); Hiroyuki Yamada, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/911,786

(22) Filed: Jul. 24, 2001

(65) Prior Publication Data

US 2002/0039699 A1 Apr. 4, 2002

(30) Foreign Application Priority Data

Aug. 3, 2000 (JP) ..... 2000-235973

(51) Int. Cl.[7] ..... G03G 9/087; G03G 9/093
(52) U.S. Cl. ..... 430/137.11; 430/137.14
(58) Field of Search ..... 430/124, 137.11, 430/137.14

(56) References Cited

U.S. PATENT DOCUMENTS 4,980,257 A * 12/1990 Anno et al. ..... 430/110
5,358,821 A * 10/1994 Bertrand et al. ..... 430/137
6,168,894 B1 * 1/2001 Aoki et al. ..... 430/99

FOREIGN PATENT DOCUMENTS

JP 63186253 8/1988

* cited by examiner

*Primary Examiner*—John Goodrow
(74) *Attorney, Agent, or Firm*—Muserlian, Lucas and Mercanti

(57) ABSTRACT

A method of preparing toner for developing an electrostatic image is disclosed. The method comprises process for adhering by fusing resin particles onto surface of colored particles (core particles) containing a resin particle and a colorant by salting-out/fusion-adhering to form the resin layer (shell).

20 Claims, No Drawings

PRODUCTION METHOD OF TONER

FIELD OF THE INVENTION

This invention relates to a toner and a production method thereof.

BACKGROUND OF THE INVENTION

Currently, a technology for synthesizing a developer for an electrostatic image by a polymerization process has been known. However, the toner particle synthesized by a suspension polymerization method has a shortcoming that such the particle is inferior in the cleaning ability since it has a spherical shape.

Consequently, a method to produce an irregular-shaped toner particle by association of a resin particle obtained by a suspension polymerization process together with a colorant particle is described in Japanese Patent Publication Open to Public Inspection No. 63-186253.

SUMMARY OF THE INVENTION

However, a colorant is exposed at the surface of the toner particle obtained by the above-mentioned method. The charging property and the developing ability of such the toner are varied, for example, when the toner is used for a long period of time under a high humid condition.

The variation of the charging property and the developing ability of the toner causes a variation or lowering of the image density or fogging, and changing of the color of a color image.

The first object of the invention is to provide a polymer toner in which the amount of the colorant existing at the surface of the toner particle is small.

The second object of the invention is to provide a polymer toner which does not cause variation of image density or occurrence of fogging caused by the change of charging property and the developing ability even when the toner is used to image formation for a long period of time.

The third object of the invention is to provide a polymer toner which does not cause variation of color of image caused by the change of the charging property and the developing ability even when the toner is used to color image formation for a long period of time.

The fourth object of the invention is to provide a method for suitably producing the excellent polymer toner as above-mentioned.

The fifth object of the invention is to provide a method for forming an image using the excellent polymer toner as above-mentioned.

1. A method of preparing toner comprising process for adhering by fusing resin particles onto surface of colored particles (core particles) containing a resin particle and a colorant by salting-out/fusion-adhering to form the resin layer (shell).
2. The method of item 1, wherein the colored particles (core particles) are formed by salting-out/fusion-adhering the resin particle (A) and the colorant particle.
3. The method of item 2, wherein process for forming the colored particles (core particles) and a process of forming the resin layer (shell) on the colored particle are continuously performed.
4. The method of item 1, wherein the colored particles (core particles) have an average spherical coefficient of from 0.850 to 0.950.

5. The method of item 1, wherein weight average molecular weight of the resin particle A (MwA) is from 15,000 to 500,000, and the weight average molecular weight of the resin particle A and weight average molecular weight of the resin particle B (MwB) satisfy relation:

$$0.1 \leqq (MwA/MwB) \leqq 20.0.$$

6. The method of item 2, wherein the resin particle B comprises a low molecular weight resin having a weight average molecular weight of from 5,000 to 20,000.
7. The method of item 2, wherein at least one of the resin particle (A) and the resin particle (B) are formed by a multistep polymerization method.
8. The method of item 7, wherein the resin particle B comprises a low molecular weight resin having a weight average molecular weight of from 5,000 to 20,000 in an amount of not less than 50% byweight.
9. The method of item 2, wherein the colored particles (core particles) are formed by salting-out/fusion-adhering the resin particle A and the colorant particle in an aqueous medium.
10. The method of item 2, wherein the colored particles (core particles) are formed by salting-out/fusion-adhering the resin particle A and the colorant particle at temperature of from Tg+10° C. to Tg+50° C.
11. The method of item 2, wherein the toner is formed by salting-out/fusion-adhering the resin particles B on the colored particles (core particles) at temperature of from Tg+10° C. to Tg+50° C.
12. The method of item 2, wherein the colored particles are formed by salting-out/fusion-adhering a resin particle A having high molecular weight, a resin particle A having middle molecular weight, a resin particle A having low molecular weight and the colorant particle.
13. The method of item 2, wherein Tg of the resin particle A is from 45 to 70° C., and Tg of the resin particle B is from 100 to 140° C.
14. The method of item 2, wherein an interval between time of addition of a salting-out agent to suspension in which the resin particle A and the colorant particle are dispersed, and time at which a temperature of suspension is reached to a temperature high than glass transition temperature Tg, a temperature at which the adherence become possible, is not more than 120 minutes.
15. The method of item 1, wherein weight average molecular weight of the resin particle A (MwA) is from 15,000 to 500,000, and the weight average molecular weight of the resin particle A and weight average molecular weight of the resin particle B (MwB) satisfy relation:

$$0.1 \leqq (MwA/MwB) \leqq 20.0.$$

16. The method of item 15, wherein the colored particles (core particles) are formed by salting-out/fusion-adhering the resin particle A and the colorant particle at temperature of from Tg+10° C. to Tg+50° C., and the toner is formed by salting-out/fusion-adhering the resin particles B on the colored particles (core particles) at temperature of from Tg +10° C. to Tg+50° C.
17. The method of item 16, wherein Tg of the resin particle A is from 45 to 70° C., and Tg of the resin particle B is from 100 to 140° C.
18. The method of item 17, wherein an interval between time of addition of a salting-out agent to suspension in which the resin particle A and the colorant particle are dispersed, and time at which a temperature of suspension is reached to a temperature high than glass transition temperature Tg, a temperature at which the adherence become possible, is not more than 120 minutes.

19. The method of item 15, wherein the resin particle B comprises a low molecular weight resin having a weight average molecular weight of from 5,000 to 20,000.

20. The method of item 15, wherein at least one of the resin particle (A) and the resin particle (B) are formed by a multistep polymerization method.

The embodiments of the invention are described.

The toner according to the invention is a toner constituted by a toner particle comprising a colored particle (core particle) containing a resin and a colorant and a resin layer (shell) adhered by fusion on the surface of the core colored particle by a salting-out/fusion-adhering method.

The toner according to the invention is a toner comprising a colored particle (core particle) obtained by salting out/fusion-adhering a resin particle A and a colorant particle, and a resin layer (shell) formed by adhering a resin particle B on the surface of the colored core particle by the salting-out/fusion-adhering method.

In the toner according to the invention, it is preferable that the weight average molecular weight of the resin particle A (MwA) is within the range of from 15,000 to 500,000, and the weight average molecular weight of the resin particle A and the weight average molecular weight of the resin particle B (MwB) satisfies the following relation.

$$0.1 \leqq (MwA/MwB) \leqq 20.0$$

In the toner according to the invention it is preferable that a low molecular weight resin having a weight average molecular weight of from 5,000 to 20,000 is contained in the fine resin particle B.

In the toner according to the invention, it is preferable that at least on of the resin particle A and the resin particle B is a combined resin particle produced by a multistep polymerization.

The production method according to the invention contains the process for adhering by fusing the resin particle onto the surface of the colored particle (core particle) containing the resin particle And the colorant by salting-out/fusion-adhering to form the resin layer (shell).

The production method according to the invention contains the process for forming the colored particle (core particle) by salting-out/fusion-adhering the resin particle A and the colorant particle and the process for adhering the resin particle B onto the surface of thus prepared colored particle (core particle) by salting-out/fusion-adhering to form the resin layer (shell).

In the production method according to the invention, it is preferable that the process for forming the colored particle (core particle) and the process of forming the resin layer (shell) on the colored particle are continuously performed.

In the production method according to the invention, it is preferable that the method includes the process for forming the resin layer (shell) on the colored particle (core particle) having an average spherical coefficient within the range of from 0.850 to 0.950.

In the production method according to the invention, it is preferable that at least one, particularly both, of the resin particle A and the resin particle B is a particle obtained by the mutistep polymerization method.

The toner according to the invention is preferably used for an image forming method containing a fixing process by a direct heating method.

DETAILED DESCRIPTION OF THE INVENTION

The colorant is not exposed at the surface of the toner since the colored particle (core particle) containing the colorant is covered with the high electro resistive resin layer (shell). Therefore, the charging property and the developing ability can be stabilized even when the toner is used for image forming for a long period of time.

Moreover, in the toner, there is no scatter in the surface property of the each of the individual particles and the distribution of the charging amount of the particles is very sharp. Accordingly, a visual image having a high sharpness can be formed during a long period of time.

The resin particle B is excellent in fusion-adhering ability and the layer forming ability onto the colored particle surface and the surface situation of the toner particle can be made smooth since the resin particle contains the low molecular weight resin having a molecular weight Mw of from 5,000 to 20,000.

<Structure of the Toner>

The toner according to the invention is composed of toner particles, which are constituted by the colored particle (core particle) covered with the resin layer containing substantially no colorant.

The resin layer (shell) constituting the toner particle is formed by fusion-adhering the resin particle (resin particle B) onto the surface of the colored particle (core particle) by the salting-out/fusion-adhering method.

The colored particle (core particle) can be prepared by salting-out/fusion-adhering the resin particle (resin particle A with the colorant particle.

In the invention, "salting-out/fusion-adhering" means the simultaneously occurrence of the salting out or coagulation of fine particles and the fusion-adhering or disappearing of the interface of particles.

For simultaneously occurring the salt out and the adhesion, it is necessary to coagulate the particles under a temperature not more than the glass transition temperature Tg of the resin constituting the resin particle.

<Molecular Weight of the Core Particle of the Toner>

The weight average molecular of resin particle A constituting the colored particle (core particle) is usually from 15,000 to 500,000, preferably from 20,000 to 200,000, more preferably from 25,000 to 150,000.

The resin particle A may be constituted by plural kinds of resin particle such as a high molecular weight resin particle, a medium molecular weight resin particle and a low molecular weight resin particle, or may be constituted by a resin particle (combined resin particle) which is prepared by forming multilayer (combing) the plural kinds of resin particle By a multistep polymerization method.

The colored particle (core particle) can be produced by salting-out/fusion-adhering the plural kinds of resin particles and the colored particle or by salting-out/fusion-adhering the combined particles and the colored particle.

The weight average molecular weight Mw of the high molecular weight resin particle (the high molecular weight component of the combined resin particle) constituting the resin particle A is usually from 160,000 to 500,000.

Sufficient internal cohesive force or the anti-offset ability can be given by the use of the resin particle A composed of such the high molecular weight resin or the high molecular component.

The weight average molecular weight Mw of the low molecular weight resin particle (the low molecular weight component of the combined resin particle) constituting the resin particle A is usually from 15,000 to 20,000.

An excellent fixing ability or the adhesion force to the image forming support can be given to the toner by the use of the resin particle A composed of such the low molecular weight resin or the low molecular component.

The weight average molecular weight Mw of the medium molecular weight resin particle (the medium molecular weight component of the combined resin particle) constituting the resin particle A is usually from 20,001 to 60,000.

<Molecular Weight of the Shell of the Toner>

The weight average molecular weight MwB of the resin particle B constituting the resin layer is preferably in the range satisfying the following relation between the weight average molecular weight of the resin particle A, MwA:

$$1.0 \leqq (MwA/MwB) \leqq 20.0.$$

The weight average molecular weight of the resin particle B, MwB, is preferably from 5,000 to 200,000. The ratio MwA/MwB is preferably less than 10.

It is preferable that a part or the whole of the resin constituting the resin particle B comprises a low molecular weight resin having a weight average molecular weight of from 5,000 to 20,000. By the presence of the low molecular weight resin in the fine resin particle B, the fusion-adhesive ability and the layer forming ability of the fine resin particle is made excellent and the surface situation of the toner can be made smooth. Thus an excellent fixing ability can be given to the toned.

The content of the low molecular weight resin having a Mw of from 5,000 to 20,000 in the resin constituting the particle B is preferably from 20 to 80%, more preferably from 30 to 70%, by weight.

The resin particle may be constituted by plural kinds of resin particle such as a medium molecular weight resin particle and a low molecular weight resin particle, or may be constituted by a combined resin particle formed by a multistep polymerization method to form a multilayered or combined resin particle of plural kind resins each different from the other in the molecular weight.

Namely, the resin layer (shell) can be formed by salting-out/fusion-adhering the plural kinds of resin particle or by salting-out/fusion-adhering the combined resin particles.

<Measurement of the Molecular Weight>

The weight average molecular weight of the resin particle A (the weight average molecular weight of the individual kind of the resin of the plural kinds of resin each having a different molecular weight and the weight average molecular weight of the whole resin, MwA), and the weight average molecular weight of the resin particle B (the weight average molecular weight of the individual kind of the resin of the plural kinds of resin each having a different molecular weight and the weight average molecular weight of the whole resin, MwB) are a molecular weight in terms of styrene measured by gel permeation chromatography (GPC).

Herein, the method for measuring the molecular weight of resins, employing GPC, is as follows. Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing a monodispersed polystyrene as standard particles. Approximately ten polystyrenes samples are preferably employed for determining said calibration curve.

Of polymerizable monomers which are employed to prepare resin particles, radical polymerizable monomers are essential components, and if desired, crosslinking agents may be employed. Further, at least one of said radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

Content ratio of the radical polymerizable crosslinking agent with respect to the monomer (or mixture of monomers) is preferably 0.1 to 10 weight %.

(3) Radical Polymerizable Monomers having an Acidic Group

Employed as radical polymerizable monomers having an acidic group are monomers having a carboxyl group such as acrylic acid, methacrylic acid, fumaric acid, maleic acid, itaconic acid, cinnamic acid, monobutyl maleate, monooctyl maleate and the like, and monomers having sulfonic acid such as styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Content ratio of the radical polymerizable monomer having acidic group with respect to the monomer (or mixture of monomers) is preferably 0.1 to 20 weight %, and more preferably 0.1 to 15 weight %.

Listed as radical polymerizable monomers having a basic group are amine based compounds such as primary amine, secondary amine, tertiary amine etc., which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

Content ratio of the radical polymerizable monomer having basic group with respect to the monomer (or mixture of monomers) is preferably 0.1 to 20 weight %, and more preferably 0.1 to 15 weight %.

(Chain Transfer Agents)

For the purpose of regulating the molecular weight of resin particles, it is possible to employ commonly used chain transfer agents.

Said chain transfer agents are not particularly limited, and for example, employed are mercaptans such as octylmercaptan, dodecylmercaptan, tert-dodecylmercaptan, and the like, carbon tetrabromide, styrene dimer, and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at at least room temperature.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyltriphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, potassium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

The surfactant is employed as an emulsifying agent of emulsion polymerization and may be employed in other processes or for other purposes.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

Employed as said organic pigments and dyes may be those conventionally known in the art. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones.

Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, , γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifier is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

<Detailed Description of the Toner>

The toner according to the invention is a toner comprising a colored particle (core particle) obtained by salting out/fusion-adhering a resin particle A and a colorant particle, and a resin layer (shell) formed by adhering a resin particle B on the surface of the colored core particle by the salting-out/fusion-adhering method.

The resin layer (shell) is not necessary to cover whole surface of the core particle. Particles composing the resin layer are preferably toner particles containing from 0.5 to 50 weight percent of resin particles B with reference to colored particles. Covering ratio of resin particle B to the surface of resin particle A (covering area of resin particle B on the surface of resin particle A/surface area of a toner particle) is preferably not less than 25 percent, and more preferably not less than 50 percent. In the most preferable embodiment, whole surface of the core is covered with shell.

Preferable examples of toner having core-shell configuration are those represented by (I) and (II).

(I) On the surface of the colored particle (core particle) prepared by salting/fusion-adhering resin particles having high molecular weight (A), resin particles having middle molecular weight (A), resin particles having low molecular weight (A) and colorant particles, a resin layer (shell) is formed by salting/fusion-adhering resin particles having middle molecular weight (B), resin particles having low molecular weight (B), for example, Toner Particles 1Bk through 11Bk, mentioned later.

(II) On the surface of the colored particle (core particle) prepared by salting/fusion-adhering resin particles (A) composed of composite particles which have multi-layered (composite) structure of high molecular weight resin, middle molecular weight resin particle And low molecular weight resin particle And colorant particles, a resin layer (shell) is formed by salting/fusion-adhering resin particles (B) composed of composite particles which have multi-layered (composite) structure of middle molecular weight resin particle And low molecular weight resin, for example, Toner Particles 12Bk through 11Bk, mentioned later.

The toner having difference of composition, molecular weight etc., between toner particles can be prepared by employing the resin particle (A) and resin particle (B), and the toner exhibiting particularly excellent characteristics such as anti-winding, anti-off-set, charging and so on.

Glass transition temperature (Tg) of resin particles (A) composing core particles is preferably from 45 to 70° C., and more preferably from 50 to 65° C.

Softening point of the resin particles (A) is preferably from 100 to 140° C.

Weight average particular diameter of the resin particles (A) is preferably from 50 to 500 nm.

Glass transition temperature (Tg) of resin particles (B) composing shell particles is preferably from 45 to 70° C., and more preferably from 50 to 65° C.

Softening point of the resin particles (A) is preferably from 100 to 140° C.

Weight average particular diameter of the resin particles (A) is preferably from 50 to 500 nm.

The glass transition temperature (Tg) is a temperature measured by DSC, that is, an intersection point of the base line and gradient of endothermic peak. Practically a differential scanning calorimeter is employed. Temperature of the sample is raised to 100° C. and is kept at the same temperature for 3 minutes and then is decreased to room temperature at the rate 10° C./minute. Then temperature of the sample is raised at the rate 10° C./minute. Transition temperature is obtained as an intersection point of the extension of the base line under glass transition point and a tangential line showing maximum inclination between rising up point to vertex of the peak.

Cited as the specific measurement apparatus can be DSC-7 manufactured by Perkin-Elmer Corp.

The softening point of the amorphous polymer denotes a value measured by employing capillary type flow tester. To be concrete, the softening point is temperature corresponding to ½ height from flow starting point to flow end point when 1 g of the sample is flow through a die having pore of 2 diameter 1 mm and 1 mm long, at a condition of load 20kg/cm with raising temperature speed of 6° C./min employing capillary type flow tester CFT-500 (manufactured by Shimadzu Corp.).

Weight average diameter (particle diameter of dispersion) of the resin particles is measured by employing an electrophoresis light scattering photometer "ELS-800" (produced by Ohtsuka Denshi Co.).

Toner particles composing the toner of the invention may contain a releasing agent. Releasing agents includes those can be dispersed in water. Practically olefin series wax such as polypropylene, polyethylene etc., denatured material of these olefin series wax, natural wax such as carnauba wax, rice wax etc., amide series wax such as fatty acid bisamide and so on.

Preferable examples of the releasing agent include crystalline ester compounds (which may be called as Specified Ester Compounds in the Specification) represented by General Formula (1), described below.

General Formula (1): $R^1—(OCO—R^2)_n$ wherein $R^1$ and $R^2$ each represent a hydrocarbon group having from 1 to 40 carbon atoms which may have a substituent, and n represents an integer of 1 to 4.

In General Formula (1), which represents specified ester compounds, $R^1$ and $R^2$ each represent a hydrocarbon group which may have a substituent.

Said hydrocarbon group $R^1$ generally has from 1 to 40 carbon atoms, preferably has from 1 to 20 carbon atoms, and more preferably has from 2 to 5 carbon atoms.

Said hydrocarbon group $R^2$ generally has from 1 to 40 carbon atoms, preferably has from 16 to 30 carbon atoms, and more preferably has from 18 to 26 carbon atoms.

Further, in General Formula (1), n is generally an integer of 1 to 4, is preferably an integer of 2 to 4, is more preferably an integer of 3 and 4, and is most preferably the integer of 4.

It is possible to suitably synthesize said specified ester compounds employing dehydration condensation reaction between alcohols and carboxylic acids.

Listed as specific examples of specified ester compounds may be those represented by formulas 1) through 22) shown below.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

-continued

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $(CH_2—O—CO—(CH_2)_{26}—CH_3)_3CH$

11) $(CH_2—O—CO—(CH_2)_{22}—CH_3)_3CH$

12) $(CH_2—O—CO—(CH_2)_{26}—CH_3)_2CH—CH_2OH$

13) $(CH_2—O—CO—(CH_2)_{22}—CH_3)_2CH—CH_2OH$

14) $(CH_2—O—CO—(CH_2)_{26}—CH_3)CH(OH)—CH_2OH$

15) $(CH_2—O—CO—(CH_2)_{22}—CH_3)CH(OH)—CH_2OH$

16) $CH_3—(CH_2)_{26}—COO—CH_2—C(CH_3)(CH_2—O—CO—(CH_2)_{26}—CH_3)_2—CH_2—O—CO—(CH_2)_{26}—CH_3$

17) $CH_3—(CH_2)_{20}—COO—CH_2—C(CH_2CH_3)(CH_2—O—CO—(CH_2)_{20}—CH_3)—CH_2—O—CO—(CH_2)_{20}—CH_3$

18) $CH_3—(CH_2)_{26}—COO—CH_2—C(CH_2—O—CO—(CH_2)_{26}—CH_3)_3—CH_2—O—CO—(CH_2)_{26}—CH_3$

19) $CH_3—(CH_2)_{20}—COO—CH_2—C(CH_2—O—CO—(CH_2)_{20}—CH_3)_3—CH_2—O—CO—(CH_2)_{20}—CH_3$

-continued

20)

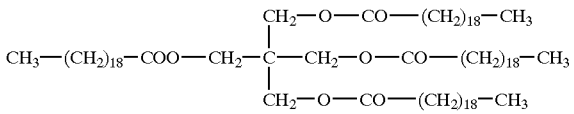

21)

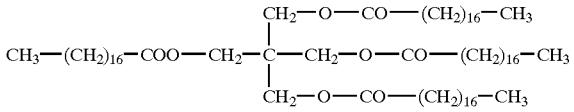

22)

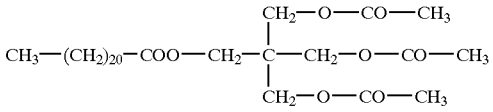

The following methods can be employed to incorporate the releasing agent into toner particles.

(1) Dispersion of wax (wax emulsion) is added during preparation process of colored particles (core particles), and the resin particles (A), the colored particles and the releasing agent particles are subjected to salting out/fusion.

(2) Resin particles (A) containing the releasing agent and colorant particles are subjected salting out/fusion during the preparation of colored particles (core particles).

(3) Dispersion of wax (wax emulsion) is added during preparation process of resin particles (shell) and the resin particles (B) and the releasing agent particles are subjected to salting out/fusion.

(4) Resin particles (B) containing the releasing agent and colorant particles are subjected salting out/fusion during the preparation of colored particles (shell particles).

The methods (1) through (4) can be combined.

The content ratio of releasing agents in the toner is commonly 1 to 30 percent by weight, is preferably 2 to 20 percent by weight, and is more preferably 3 to 15 percent by weight.

In the same manner, it is possible to employ various charge control agents known in the art, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

A method to incorporate the releasing agent into toner particles can be applied to a method to incorporate the charge control agents the into toner particles.

<Particle Diameter of Toner Particles>

Herein, the toner particle diameter of the present invention is from 3 to 9 μm in terms of the volume average particle diameter. The average diameter can be controlled by varying concentration of the coalescent agent (salting agent), amount of organic solvent to be added, period for fusing, composition of the polymer and so on during the preparation of toner.

The volume average particle diameter of toner particles, can be measured by employing a Coulter Counter TA-II, a Coulter Multisizer. Herein values are shown which are obtained based on the particle diameter distribution in the range of from about 2.0 to about 40 μm, employing an aperture having an aperture diameter of 100 μm of said Coulter Counter TA-II as well as said Coulter Multisizer.

<Measuring Condition>

(1) Aperture: 100 μm (2) Preparation Sample: An adequate amount of surfactant (neutral detergent) is added to from 50 to 100 ml of electrolyte (ISOTON R-11, manufactured by Coulter Scientific Japan) and they are mixed. To the mixture, from 10 to 20 mg of the sample is added. They are subjected to dispersion treatment by means of an ultrasonic homogenizer.

Further, the toner of the present invention is preferred in which the amount of minute toner powder having a diameter of not more than 2.0 μm is not more than 20 percent by number with respect to the total in term of the number distribution, and is more preferred in which the amount of minute toner powder particles having a diameter of not more than 2.0 μm is not more than 10 percent by number. It is possible to determine the amount of said minute toner powder particles employing a electrophoresis light scattering photometer ELS-800, produced by Ohtsuka Denshi Co. In order to adjust the particle diameter distribution to said range, the temperature during the salting-out/fusion stage, is preferably controlled in the narrow range. Specifically, the temperature is quickly increased, that is, the temperature increase rate is enhanced. These conditions have been described previously. The time to increase the temperature to said specified value is generally less than 30 minutes, and is preferably less than 10 minutes, and the temperature increase rate is preferably from about 1 to about 15° C./minute.

<Shape of Toner Particles>

Further, as the toner shape of the present invention, an average value (an average circularity) of the shape coefficient (circularity) described by the formula shown below is preferably from about 0.930 to about 0.980, and is more preferably from about 0.940 to about 0.975.

Shape coefficient=(circumferential length of a circle obtained based on the diameter equivalent to a circle)/(circumferential length of the projected toner image) By adjusting said average circularity to the range of from about 0.930 to about 0.980, it is possible to make the toner shape undefined and to make heat transfer more efficient so that fixability can be further improved. Namely, by adjusting the average circularity to not more than 0.980, it is possible to enhance fixability. Further by adjusting the average circularity to at least 0.930, the degree of undefined particle shape is controlled so that pulverization properties of particles due to stress during extended use can be retarded.

Further, the shape coefficient preferably has a narrow distribution, and the standard deviation of the circularity is preferably not more than 0.10. The CV value obtained by the formula shown below is preferably less than 20 percent, and is more preferably less than 10 percent.

$$CV \text{ value} = (\text{standard deviation of circularity}/\text{average circularity}) \times 100$$

By adjusting the standard deviation of the circularity to not more than 0.10, it is possible to prepare toner particles having a uniform shape and to minimize the difference in fixability between toner particles. As a result, an increase in the fixing ratio as well as effects to minimize staining of the fixing unit is further exhibited. Further, by adjusting the CV value to less than 20 percent, it is possible to narrow the size distribution in the same manner and to more markedly exhibit fixability enhancing effects.

Methods for measuring said shape coefficient are not limited. For example, toner particles are enlarged by a factor of 500 employing an electron microscope and photographed. Subsequently, the circularity of at least 500 toner particles is determined, employing an image analysis apparatus. The arithmetic average is then obtained so that an average circularity can be calculated. Further, as a simple measurement method, it is possible to conduct measurement, employing FPIA-1000 (produced by Toa Iyodenshi Co., Ltd.).

Monitoring as described herein means that process conditions are controlled based on measurements obtained by measurement devices incorporated into the production line. For example, when a toner is prepared employing the polymerization method in which resin particles are associated or fused in an aqueous medium, during the fusing process and the like, sampling is successively carried out to measure the shape as well as particle diameter, and when the targeted shape is obtained, the reaction is terminated.

The monitoring methods are not particularly limited, and a flow type particle image analyzer FPIA-2000 (manufactured by Toa Iyo Denshi Co.) may be used. Said device is suitably employed because shapes can be monitored in real-time from a flowing sample liquid. Namely, the particle shape and the like in a sample which is fed to said device from the reaction vessel, employing a pump, is continually monitored, and when the desired shapes are obtained, the reaction is terminated.

<External Additives>

For the purpose of improving fluidity as well as chargeability, and of enhancing cleaning properties, the toner of the present invention may be employed into those in which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic.

Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

Further, employed as fine organic particles are fine spherical organic particles having a number average primary particle diameter of from about 10 to about 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably from about 0.1 to about 5 percent by weight with respect to the toner.

<Producing Method According to the Invention>

The production method of the invention is characterized that the method includes the process for adhering the resin particle onto the surface of the colored particle (core particle) by the salt-out/fusion-adherence to form the resin layer (shell). In concrete, the method includes the process for salting-out/fusion-adhering the resin particle A and the colorant particle to form the colored particle, and the process for salting-out/fusion-adhering the resin particle B onto thus obtained colored particle to form the resin layer.

An example of the production method is constituted by the following processes:

(1) a polymerization process for preparing the resin particle A,
(2) a polymerization process for preparing the resin particle B,
(3) a salting-out/fusion-adhering process for salting-out/fusion-adhering the resin particle A and the colorant particle in an aqueous medium to form the colored particle (core particle),
(4) a salting-out/fusion-adhering process for salting-out/fusion-adhering resin particle B onto the surface of the colored particle (core particle) to form the resin layer for preparing the toner particle having the core-shell structure,
(5) a filtering-washing process for separating the toner particle from the aqueous suspension of the toner particle by filtration to remove an unnecessary composition such as a surfactant,
(6) a drying process for drying the washed toner, and
(7) a process adding an external additive to the dried toner particle.

The processes are each described below.

(Polymerization Process for Preparing the Resin Particle A)

Generally, a known polymerization method such as a emulsification polymerization method and suspension polymerization can be applied to this polymerization process. In an example of the polymerization method, a radical polymerization initiator is dissolved in an aqueous medium such as an aqueous solution of a surfactant, and heated. A radical polymerizable monomer or a mixture of the monomer is added to the solution when the temperature of the solution is reached to a designated temperature, a polymerization temperature, and the system is heated while stirring usually in a nitrogen atmosphere.

In this case, it is preferable that at least one of a radical polymerizable monomer having an acidic group and a radical polymerizable monomer having a basic group is contained in the mixture of monomer in an amount of from 0.1 to 20% by weight.

The temperature and time of the polymerization may be suitably set within the range in which the polymerization reaction can be occurred.

The molecular weight of the resin particle A can be controlled by the amount of the polymerization initiator, the reaction temperature and an addition of a chain-transfer agent. It is preferable to add the chain-transfer agent in a form of a mixture with the radical polymerizable monomer when the chain-transfer agent is used to control the molecular weight of the resin.

The particle diameter of thus obtained resin particle A is within the range of from 50 to 500 nm in terms of weight average diameter.

The following method can be cited as a method suitably applied for preparing the resin particle A having two or more peaks in the molecular weight distribution thereof: resin particles are prepared by an ordinary method such as an emulsification polymerization, the radical polymerizable monomer is further added to thus obtained dispersion of the resin particles and polymerization is further performed to for a multilayered or a combined particle.

In concrete, the following process can be applied to prepare the multilayered or combined resin particle constituted by a high molecular weight resin particle A medium molecular weight resin particle And a low molecular weight resin particle A polymerization initiator and a mixture of monomers for forming the medium molecular weight resin particle Are added into a dispersion liquid of resin particles each composed of the high molecular weight resin prepared by an usual polymerization treatment, the first polymerization step. This system is subjected to a polymerization treatment, the second polymerization step. Then the polymerization initiator and a mixture of monomers to form the low molecular weight resin particle Are added into thus obtained suspension of the combined particle of the high molecular weight resin particle And the medium molecular weight resin particle And the system is subjected to a polymerization treatment, the third polymerization step.

A method can be applied to prepare a resin particle containing a releasing agent to be used as the resin particle A, by which the releasing agent is dissolved in the monomer and the solution is dispersed in an aqueous medium and the system is subjected to a polymerization treatment to obtain latex of the resin particle. The weight average particle diameter of thus obtained resin particle A containing the releasing agent is preferably within the range of from 50 to 2,000 nm.

The "aqueous medium" means a medium comprising from 50% to 100% by weight of water and from 0% to 50% by weight of water a miscible organic solvent. Examples of the water miscible solvent include methanol, ethanol, isopropanol, butanol, acetone, methyl ethyl ketone and tetrahydrofuran. An alcoholic organic solvent which does not dissolve the obtained resin is preferable.

The following method can be described as a preferable polymerization method to form the resin particle containing the releasing agent: a monomer solution in which the releasing agent is dissolved, is dispersed in a form of oil drop in an aqueous medium in which a surfactant is dissolve in a concentration less than the critical micelle forming concentration by applying mechanical energy to prepare a suspension, a water-soluble polymerization initiator is added to thus obtained suspension to occur radical polymerization, hereinafter referred to "miniemulsion method". An oil-soluble polymerization initiator may be added to the monomer solution in place of or together with the water-soluble polymerization initiator.

As the dispersing machine to be used for carrying out the oil drop dispersion by mechanical energy, for example, a stirring apparatus Clearmix manufactured by M Technique Co., Ltd. having a high speed rotating rotor, an ultrasonic dispersing machine, a mechanical homogenizer, Manton-Gourin Homogenizer and a pressure homogenizer. The diameter of the dispersed particle is usually from 10 to 1,000 nm, preferably from 30 to 300 nm.

(Polymerization Process for Preparing the Resin Particle B)

A known polymerization method such as an emulsion polymerization and a suspension polymerization method can be applied to this polymerization process similarly to the polymerization process to prepare the resin particle A.

The diameter of the resin particle B constituting the shell is preferably within the range of from 50 to 500 nm in terms of weight average diameter.

The following method can be cited as a method suitably applied for preparing the resin particle B having two or more peaks in the molecular weight distribution thereof: resin particles are prepared by an ordinary method such as an emulsification polymerization, the radical polymerizable monomer is further added to thus obtained dispersion of the resin particles and polymerization is further performed to make a multilayered or combined particle.

In concrete, the following process can be applied to prepare a multilayered or combined resin particle composed of a medium molecular weight resin particle And a low molecular weight resin particle A polymerization initiator and a mixture of monomers for forming the low molecular weight resin particle Are added into a dispersion liquid of resin particle constituted by the medium molecular weight resin prepared by an usual polymerization treatment, the first polymerization step, then the system is subjected to a polymerization treatment, the second polymerization step.

The resin particle B containing a releasing agent can be prepared by a method similar to the method, preferably the miniemulsion method, for preparing the resin particle A containing the releasing agent.

(Salting-out/fusion-adhering Process for Preparing the Colored Core Particle)

The salting-out/fusion-adhering process is a process to obtain an irregular, not spherical, shaped colored particle by simultaneously salting-out/fusion-adhering the resin particle A and the colorant particle in an aqueous medium.

An external additive particle having a number average primary particle diameter of from 50 to 500 nm such as a releasing agent and a charge controlling agent may be salted-out/fusion-adhered together with the resin particle A and the colored particle.

The surface of the colored particle may be modified. A known agent can be used as the surface modifying agent.

The resin particle A is subjected to the salting-out/fusion-adhering treatment in the dispersed state in the aqueous medium. As the aqueous medium, an aqueous solution is usable in which a surfactant is dissolved in a concentration of not less than the critical micelle concentration (CMC).

The surfactant used in the polymerization process can be used as the above-mentioned surfactant.

As the dispersing machine to be used for dispersing the colored particle, a medium type dispersing machine such as a stirring apparatus Clearmix manufactured by M Technique Co., Ltd. having a high speed rotating rotor, an ultrasonic dispersing machine, a mechanical homogenizer, Manton-Gourin Homogenizer, a pressure homogenizer, a Gettman mill and a diamond fine mill, are preferably used.

It is necessary for salting-out/fusion-adhering the resin particle A to the colored particle to add a salting-out agent or coagulating agent in a concentration of not less than the critical coagulation concentration and to heat up the suspension to a temperature of not less than the glass transition temperature Tg of the resin particle A.

The temperature range suitable for slating-out/fusion-adhering is from Tg+10° C. to Tg+50° C., particularly preferably from Tg+15° C. to Tg+40° C.

The glass transition temperature Tg may by substantially lowered by an addition of a water-miscible organic solvent to effectively occur the salting-out/fusion-adhering.

An alkali metal salt and an alkaline earth metal salt are usable as the salting-out agent at the salting-out/fusion-adhering process.

The alkaline metal constituting the salting-out agent includes lithium, potassium and sodium, and the alkali-earth metal constituting the salting-out agent includes magnesium, calcium, strontium and barium. Among them, potassium, sodium, magnesium, calcium and barium are preferable.

A chloride ion, a bromide ion, an iodide ion, a carbonate ion and a sulfate ion are preferred as the counter ion of the alkaline and alkaline earth metals.

As the "water-miscible organic solvent" usable at the time of sating-out/fusion-adhering the resin particle includes methanol, ethanol, 1-propanol, 2-propanol, ethylene glycol, glycerol and acetone. Among them an alcohol having 3 or less carbon atoms such as methanol, ethanol, 1-propanol and 2-propanol, and 2-propanol is particularly preferred.

The temperature of the suspension, in which the resin particle A and the colorant particle are dispersed, at the time of addition of the sating-out agent is preferably lower than the glass transition temperature Tg of the resin particle A. In concrete, the temperature is preferably within the range of from 5° C. to 50° C., more preferably from 10° C. to 45° C.

When the temperature of the suspension at the time of addition of the salting-out agent is higher than the glass transition temperature Tg of the resin particle A, the particle diameter become to be difficultly controlled and a coarse particle tends to be formed.

As above-mentioned, in the salting-out/fusion adhering process, it is necessary to add the salting-our agent into the suspension of the resin particle A and the colorant particle while the temperature of the suspension is kept lower than the glass transition temperature Tg, and after that to rapidly heat up the suspension to a temperature higher than the transition temperature Tg of the resin particle A.

The interval between the time of the addition of the salting-out agent to the suspension in which the resin particle A and the colorant particle are dispersed, and the time at which the temperature of the suspension is reached to a temperature high than the glass transition temperature Tg, a temperature at which the adherence become possible, is usually not more than 120 minutes, preferably not more than 90 minutes to occur the salt-out/fusion-adherence, namely to simultaneously occur the salt-out and the fusion-adherence.

When the interval exceeds 120 minute, the coagulating situation of the particles coagulated by salting-out is changed so that the diameter distribution of the colored particles obtained by fusion-adherence of the coagulated particle is made broad or the surface property of the finally obtained toner particle is changed.

The interval from the addition of the salting-out agent to the suspension to the start of heating is usually not more than 30 minutes, preferably not more than 15 minutes, more preferably not more than 10 minutes. The temperature raising rate of the suspension after the addition of the salting-out agent is preferably from 0.25° C. to 15° C. per minute, more preferably from 1° C. to 15° C. per minute. When the temperature rising rate is too small, a long period of time is required to reach to a temperature higher than the glass transition temperature Tg so that the salting-out and the fusion-adhering cannot be occurred simultaneously. On the other hand, the temperature raising rate is too large, the particle diameter is hardly controlled and a coarse particle tens to be formed.

The diameter of thus obtained colored particle (core particle) is preferably within the range of from 2 $\mu$m to 9 $\mu$m in terms of volume average particle diameter.

The average spherical degree of the colored particles is preferably from 0.850 to 0.950, more preferably from 0.860 to 0.940.

When the average spherical degree is less than 0.850 (the irregularity is excessive), a uniform covering of the resin layer (shell) is difficultly formed. On the other hand, when the average spherical degree exceeds 0.950, the average spherical degree of the finally obtained toner particle is exceeded to 0.980 so that the fixing ability is often degraded.

(Salting-out/fusion-adhering Process for Preparing the Core/shell Type Toner Particle)

This process is a process to form a resin layer (shell) by salting-out/fusion-adhering the resin particle B onto the surface of the colored particle (core particle) prepared as the above-mentioned to form the irregular-shaped toner particle having a core/shell structure.

The salting-out/fusion-adhering process includes;

(i) the step for growing the colored particle (core particle) by adhering the resin particle B onto the colored particle, and (ii) the step for ripening for controlling the layer formation and the particle shape by the heating treatment after finish of the particle growing.

To fusion-adhere the resin particle B onto the surface of the colored particle (core particle), it is preferable to perform the shell forming process continuous to the salting-out/fusion-adhering process for obtaining the colored particle.

It is preferable that the dispersion of the resin particle B is added to the colored particle suspension prepared by the above-mentioned process, which contains the salting-out agent and the water-miscible organic solvent according to necessity and is maintained at a temperature higher than the glass transition temperature of the resin constituting the particle B, and the temperature of the mixture is kept at a temperature higher than the glass transition temperature of the resin of the resin particle B.

The range of the temperature suitable for occurrence of the salting out/fusion-adhering of the particles is from Tg+10° C. to Tg+50° C., preferably from Tg+15° C. to Tg+40° C.

The adding amount of the dispersion of the resin particle B is preferably an amount so that the weight of the resin particle B is from 1% to 30% of the weight of the toner particle.

The shape of thus obtained core/shell structured toner particle, preferably having an average spherical degree of from 0.930 to 0.980, can be controlled by controlling the shape of the colored particle as the core particle, preferably having an average spherical degree of from 0.850 to 0.950, and the heating condition of the ripening step of the salting-out/fusion-adhering process.

(Filtering and Washing Process)

In the filtering and washing process, a filtering treatment for separating by filtration the toner particles from the toner particle suspension obtained by the above-described process, and washing treatment for removing an adhered substance such as the surfactant and the salting-out agent from a cake of the separated toner particles formed by the filtration are applied.

A centrifugal method, a vacuum filtration method using a glass filter funnel and a method using a filter press are usable even though there is no limitation on the method of filtration.

(Drying Process)

The process is a process for drying the washed toner particles. In the drying process, a drying apparatus such as a spray dryer, a vacuum freeze drying machine, and a vacuum drying machine is usable, and a stationary rack dryer, a moving rack dryer, a fluid bed dryer, a rotary dryer and a stirring dryer are preferably used.

The moisture content of the toner particles after drying treatment is preferably not more than 5%, more preferably not more 2%, by weight.

When the toner particles are coagulated with together by a weak inter-particle force, the coagulation may be subjected to a crushing treatment. A mechanical crushing apparatus such as a jet mill, a Henschel mixer, a coffee mill and a food processor is usable for the crushing treatment.

(External Additive Addition Process)

This process is a process to add an external additive to the dried toner particles. Various known mixing apparatus such as a tabular mixer, a Henschel mixer, a Tauner mixer and a V-type mixer can be used for adding the external additive.

(Developer)

The toner according to the invention can be used not only as a one-component developer but also as a two-component developer together with a carrier.

When the toner is used as the two-component developer, a known material such as a metal, for example, iron, ferrite and magnetite, and an alloy of the metal with aluminum or lead may be used for the carrier. Ferrite is particularly preferred. The volume average particle diameter of the carrier is preferably from 15 $\mu$m to 100 $\mu$m, more preferably from 24 $\mu$m to 60 $\mu$m. The volume average particle diameter of the carrier can be measured by a laser diffraction particle size distribution measuring apparatus "HELOS" having a wet dispersing device, manufactured by Sympatec Co., Ltd.

A resin-coated carrier in which the surface of the carrier particle is covered with a resin and a carrier so-called resin dispersed type carrier in which the carrier particle is dispersed in a resin are preferably used.

Examples of the resin constituting the resin-coated carrier include an olefin resin particle A styrene resin particle A silicone resin particle A styrene/acryl resin particle A silicone resin particle An ester resin particle And a fluorine-containing polymer resin, even though there is no limitation on the resin.

A known resin can be used as the resin constituting the resin dispersion type carrier such as a styrene/acryl resin particle A polyester resin particle A fluorine-containing resin particle And a phenol resin, even though there is no limitation on the resin.

(Fixing Process and Condition Thereof)

The toner according to the invention is suitably applicable to the image forming method according to the invention which includes a fixing process by direct heating method, by which the toner image transferred onto the image support is contacted to a heating member such as a heating roller.

As the contact heating method, a pressing-heating fixing method, particularly a heating roller fixing method and a pressing-heating fixing method by which the fixing is performed by a rotating pressing member including a fixed heating member.

In an example of the heating roller fixing method, a device is used which is constituted by an upper roller constituted by a metal cylinder made of iron or aluminum having a heat source in the inside thereof and the surface thereof is covered with a polymer such as a tetrafluoroethylene- or polytetrafluoroethylene-perfluoroalkoxyvinyl ether copolymer, and a lower roller constituted by silicone rubber. In concrete, the upper roller has a line-shaped heater as the heat source which raises the temperature of the roller surface to approximately 120° C. to 200° C. At the fixing portion, a pressure is applied between the upper and the lower rollers to deform the lower roller so as to form a nip. The width of the nip is from 1 mm to 10 mm, preferably from 1.5 mm to 7 mm. The line speed of the fixing is preferably from 40 mm to 600 mm per second. When the nip is too narrow, an unevenness of fixing is formed since it is difficult to uniformly heat the toner. On the other hand, the offset is excessively occurred since the fusion of the resin is accelerated when the nip is too wide.

A cleaning means may be attached to the fixing process. In such the case, a method of supplying silicone oil onto the upper roller or a film in the fixing process or a method of cleaning using a pad, a roller or a web witch is immersed with silicone oil, are usable. Silicone oil having a high heat resistively such as polydimethylsiloxane, polymethylphenylsiloxane, polydiphenylsiloxane and fluorine-containing polysiloxane is used. One having a viscosity from 1,000 cp to 100,000 cp at 20° C. is suitably used since one having a low viscosity is excessively flowed.

EXAMPLES

The examples pf the invention are described below.

Preparation Example HP-1

A surfactant solution, an aqueous medium, prepared by dissolving 7.08 g of an anionic surfactant, sodium dodecylsulfonate (SDS), in 2760 g of ion exchanged water was charged into a 5000 ml separable flask on which a stirring device, a thermo sensor, a cooler and a nitrogen introducing device were attached, and the interior temperature was raised to 80° C. while stirring at a stirring speed of 230 rpm in a nitrogen gas atmosphere.

A polymerization initiator solution prepared by dissolving 4.5 g of potassium persulfate (KPS) in 200 g of ion exchanged water is added to the surfactant solution and the temperature of the solution was adjusted to 75° C. Then a mixed monomer liquid composed of 115.1 g of styrene, 42.0 g of n-butyl acrylate and 10.9 g of acrylic acid was dropped into the solution spending one hour. The system was heated and stirred for 2 hours at 75° C. to prepare a kind of latex, a dispersion of high molecular weight resin particles. This latex was referred to "Latex PH-1".

The weight average molecular weight Mw of the resin particles constituting Latex HP-1 was 318,000, and the weight average particle diameter of the resin particle was 105 nm.

Preparation Example HP-2

A kind of latex, a dispersion of a high molecular weight resin particle was prepared in the same manner as in Latex PH-1 except that the reaction temperature was changed to 85° C. The latex was referred to Latex PH-2.

The weight average molecular weight Mw of the resin particles constituting Latex HP-2 was 235,000, and the weight average particle diameter of the resin particle was 106 nm.

Preparation Example HP-3

A kind of latex, a dispersion of a high molecular weight resin particle, was prepared in the same manner as in Latex PH-1 except that the adding amount of the polymerization initiator (KPS) was changed to 0.90 g. The latex was referred to Latex HP-3.

The weight average molecular weight Mw of the resin particles constituting Latex HP-3 was 262,000, and the weight average particle diameter of the resin particle was 110 nm.

Preparation Example HP-4

A kind of latex, a dispersion of a high molecular weight resin particle, was prepared in the same manner as in Latex PH-1 except that the adding amount of the polymerization initiator (KPS) was changed to 0.90 g and the reaction temperature was changed to 80° C. The latex was referred to Latex HP-4.

The weight average molecular weight Mw of the resin particles constituting Latex HP-4 was 195,000, and the weight average particle diameter of the resin particle was 110 nm.

Preparation Example MP-1

Into a flask having a stirring device, a monomer mixture liquid composed of 383, 6 g of styrene, 140.0 g of butyl acrylate, 36.4 g of methacrylic acid and 5.6 g of dodecylmercaptane was charged and 72.0 g of the compound represented by the foregoing Formula 19, hereinafter referred to Exemplified compound 19, was added to the liquid and dissolved by heating at 80° C. to dissolve the compound to form a monomer solution.

On the other hand, a surfactant solution, an aqueous medium, prepared by dissolving 1.6 g of an anionic surfactant (SDS) in 2000 g of ion exchanged water was charged into a 5000 ml separable flask on which a stirring device, a thermo sensor, a cooler and a nitrogen introducing device were attached.

Then the foregoing monomer solution (80° C.) was dispersed in the surfactant solution (80° C.) by a mechanical dispersing machine Clearmix, manufactured by M-Technique Co., Ltd., having a cycling flow channel to prepare a dispersion comprising emulsified particles, oil particles, each having a similar particle diameter.

Thereafter, an initiator solution composed of 19.1 g of the polymerization initiator (KPS) and 240 g of ion exchanged water and 750 g of ion exchanged water were added to the suspension, and a polymerization reaction was occurred by heating and stirring this system at 80° C. for 3 hours to prepare a kind of latex, a dispersion of particles of resin having a medium molecular weight and containing Exemplified compound 19. The latex was referred to Latex MP-1.

The weight average molecular weight Mw of the resin particles constituting Latex MP-1 was 93,000, and the weight average particle diameter of the resin particle was 105 nm.

Preparation Example MP-2

A kind of latex containing, a dispersion of particles of resin having a medium molecular weight and containing Exemplified compound 19 was prepared in the same manner as in preparation example MP-1 except that the amount of dodecylmercaptane was changed to 8.3 g. Thus obtained latex was referred to "Latex MP-2".

The weight average molecular weight Mw of the resin particles constituting Latex MP-2 was 85,000, and the weight average particle diameter of the resin particle was 110 nm.

Preparation Example MP-3

A kind of latex, a dispersion of particles of resin having a medium molecular weight and containing Exemplified compound 19, was prepared in the same manner as in preparation example MP-1 except that the amount of Exemplified compound 19 was changed to 144.0 g. Thus obtained latex was referred to "Latex MP-3".

The weight average molecular weight Mw of the resin particles constituting Latex MP-3 was 93,000, and the weight average particle diameter of the resin particle was 110 nm.

Preparation Example MP-4

A kind of latex, a dispersion of particles of resin having a medium molecular weight and containing Exemplified compound 21, was prepared in the same manner as in preparation example MP-1 except that Exemplified compound 19 was replaced by 72.0 g of the compound represented by Formula 21, hereinafter referred to Exemplified compound 21. Thus obtained latex was referred to "Latex MP-4".

The weight average molecular weight Mw of the resin particles constituting Latex MP-4 was 105,000, and the weight average particle diameter of the resin particle was 110 nm.

Preparation Example MP-5

A kind of latex, a dispersion of particles of resin having a medium molecular weight and containing Exemplified compound 18 was prepared in the same manner as in preparation example MP-1 except that Exemplified compound 19 was replaced by 72.0 g of the compound represented by Formula 18, hereinafter referred to Exemplified compound 18. Thus obtained latex was referred to "Latex MP-5".

The weight average molecular weight Mw of the resin particles constituting Latex MP-5 was 105,000, and the weight average particle diameter of the resin particle was 115 nm.

Preparation Example LP-1

A surfactant solution, an aqueous medium, composed of 5000 g of ion exchanged water and 60 g of an anionic surfactant (SDS) dissolved in the water was charged in a flask on which a stirring device, a thermo sensor, a cooling pipe and a nitrogen introducing device were attached, and the temperature of the solution was raised to 80° C. while stirring at a stirring speed of 230 rpm in a nitrogen atmosphere.

A polymerization initiator solution composed of 22.8 g of the polymerization initiator (KPS) was added to the surfactant solution. Then a monomer mixture liquid composed of 850 g of styrene, 252 g of butyl acrylate, 98 g of methacrylate and 32 g of t-dodecylmercaptane was dropped to the above-obtained solution for 1 hour while maintaining the temperature at 80° C. This system was heated and stirred for 2 hours to form a kind of latex, a suspension of particles of a low molecular weight resin. The latex was referred to "latex LP-1".

The weight average molecular weight Mw of the resin particles constituting Latex LP-1 was 18,000, and the weight average particle diameter of the resin particle was 110 nm.

Preparation Example HML-1

(1) Preparation of a Nucleus Particle, the First Step of Polymerization

A surfactant solution, an aqueous medium, prepared by dissolving 7.08 g of an anionic surfactant, sodium dodecylsulfonate (SDS), in 2760 g of ion exchanged water was charged into a 5000 ml separable flask on which a stirring device, a thermo sensor, a cooler and a nitrogen introducing device were attached, and the interior temperature was raised to 80° C. while stirring at a stirring speed of 230 rpm in a nitrogen atmosphere.

A polymerization initiator solution prepared by dissolving 0.42 g of potassium persulfate (KPS) in 200 g of ion exchanged water is added to the surfactant solution and the temperature of the solution was adjusted to 75° C. Then a mixed monomer liquid composed of 115.1 g of styrene, 42.0 g of n-butyl acrylate and 10.9 g of acrylic acid was dropped into the solution spending one hour. The system was heated and stirred for 2 hours at 75° C. to perform the first step of the polymerization. Thus a kind of latex, a suspension of particles of resin composed of a high molecular weight resin, was obtained. This latex was referred to "Latex 1H".

(2) Formation of Medium Layer, Second Step Polymerization

In a flask having a stirring device, a monomer solution was prepared by dissolving 72 g of Exemplified compound 19 in a mixture liquid of monomer composed of 383.6 g of styrene, 140.0 g of n-butyl acrylate, 36.4 g of acrylic acid and n-octyl 3-mercaptopropionate at 80° C.

Besides, a surfactant solution composed of 2000 ml of ion exchanged water and 1.6 g of the anionic surfactant (SDS) dissolved in the water was heated to 80° C. Then the foregoing monomer solution of Exemplified compound 19 was dispersed in the surfactant solution by a mechanical dispersing machine Clearmix, manufactured by M-Technique Co., Ltd., having a cycling flow channel to prepare a dispersion comprising emulsified particles, oil particles, each having a similar particle diameter of 110 nm.

Then a polymerization initiator solution composed of 240 ml of ion exchanged water and 19.1 g a polymerization initiator, potassium persulfate (KPS) dissolved in the water and 750 ml of ion exchanged water were added to Latex 1H, and the system was heated up to 800. The foregoing dispersion was added to this system and the system was heated and stirred for 3 hours at 80° C. to perform a second step of polymerization. Thus a kind of latex, a dispersion of the high molecular weight resin particles covered with the medium molecular weight resin, was obtained. This latex is referred to "Latex 1M".

(3) Formation of Outer Layer, the Third Step of Polymerization

To the foregoing Latex 1M obtained as above-mentioned an initiator solution composed of 200 ml of ion exchanged water and 22.8 g of the polymerization initiator (KPS) dissolved in the water, and 750 ml of ion exchanged water were added. A mixed monomer liquid composed of 850 g of styrene, 525 g of n-butyl acrylate, 98 g of methacrylic acid and 32 g of n-octyl 3-mercaptoporopionate was dropped into the foregoing latex spending 1 hour at 80° C. Thereafter, the system was heated and stirred for 2 hours to carry out the third step of polymerization and cooled to 30° C. Thus latex was obtained which is a dispersion of combined resin particles each having a central portion composed of the high molecular weight resin particle An interlayer composed of the medium molecular weight resin containing Exemplified compound 19 and a outer layer composed of the low molecular weight resin. The latex was referred to "Latex HLMP-1".

The weight average molecular weight Mw of the resin particles constituting Latex HLMP-1 was 8,900, and the weight average particle diameter of the resin particle was 125 nm.

(Production example of 1BK)

In 1600 ml of ion exchanged water, 90 g of sodium n-dodecylsulfate was dissolved. To this solution, Two hundreds gram of carbon black Mogal L, manufactured by Cabot Co., Ltd., was gradually added and dispersed by Clearmix, M-Technique Co., Ltd., to prepare a dispersion of colorant particles. The dispersion was referred to "Colorant dispersion Bk". The weight average diameter of the colorant particle measured by an electrophoretic light scattering photometer ELS-800, manufactured by Ootsuka Electron Co., Ltd., was 101 nm.

In a reaction vessel having a thermo sensor, a cooling pipe, a nitrogen introducing device and a stirring device, 3000 g of Latex HP-1 obtained in Preparation example HP-1, 2500 g of Latex MP-1 obtained in Preparation example MP-1, 6000 g of Latex LP-1 obtained in Preparation example LP-1, 2000 g of ion exchanged water and 1800 g of Colorant dispersion Bk were charged and stirred. After the temperature of the contents was adjusted to 30° C., and a 5N-solution of sodium hydroxide was added so as to adjust the pH of the solution to 11.0. Then a solution composed of 720 ml of ion exchanged water and 526 g of magnesium chloride 6 hydrate dissolved in the water was dropped spending 10 minutes at 30° C. while stirring. After standing for 3 minutes, the latex was heated up to 90° C. spending 6 minutes at a rate of 10° C. per minute. At this situation, 2000 g of Latex MP-1 prepared in preparation example MP-1, 3000 g of Latex LP-1 prepared in preparation example LP-1, and a solution composed of 500 ml of ion exchanged water and 400 g of magnesium chloride dissolved in the water was added and stirred for 30 minutes when the volume average particle diameter of the adhered particles measured by Coulter Counter TA-11 was become to 6.5 $\mu$m and the average spherical degree of the adhered particles, colored particles, measured by a shape measurement apparatus (FPIA) built in-line was become 0.860. Then a solution composed of 7000 ml of ion exchanged water and 1150 g of sodium chloride dissolved in the water was added to stop the particle growing. Then the latex was heated and stirred for 2 hours at 85° C. to continue the adherence of particle as a ripening treatment. Thereafter, the latex was cooled to 30° C. at the rate of 8° C. per minute, and hydrochloric acid was added so as to adjust pH to 2.0, and stirring was stopped. The particles thus formed was filtered, repeatedly washed by ion exchanged water and dried by wind warmed at 40° C. to obtain toner particle. Thus obtained toner particle was referred to "Toner particle 1Bk".

Production Examples 2Bk through 12Bk

Toner particles were prepared according to the formulas shown in Table 1 in the same manner as in Production example 1Bk except that at least one of (1) the kind of latex, a dispersion of resin particles A, initially charged to the reaction vessel to form colored particles, core particles but the amount of the latex was the same, (2) the kind of the latex, dispersion of resin particle B, added to form the resin layer (shell) but the amount of the latex was the same, (3) The average spherical degree of the adhered particle (core particle) at the time of the addition of the latex to form the resin layer, (4) the temperature of the ripening treatment, and (5) the period of time of the ripening treatment. Thus obtained toner particles were each referred to "Toner particle 2Bk" through "Toner particle 12Bk".

Example 14Bk

"Toner particle 14Bk" was prepared in the same way as "Toner particle 1Bk" except that 5000 g of Latex LP-1 prepared in preparation example LP-1 was added in place that 2000 g of Latex MP-1 prepared in preparation example MP-1 and 3000 g of Latex LP-1 prepared in preparation example LP-1 were added, when the volume average particle diameter of the adhered particles measured by Coulter Counter TA-11 was become to 6.5 $\mu$m and the average spherical degree of the adhered particles, colored particles, measured by a shape measurement apparatus (FPIA) built in-line was become 0.860, in the Production example of 1BK.

Example 15BK

Toner particles prepared by shelling on pulverized particles. The mixture of 100 weight by parts of styrene acryl resin, 10 weight by parts of carbon black, 7 weight by parts of Exemplified compound (19) and 1 weight by parts of azo iron complex was blended by Henschel mixer, and was kneaded by a double axis kneader. The mixture was pulverized by a jet type pulverizer and obtained powder was classified by air classifier to obtain toner articles having average particle size of 6.5 $\mu$m. Obtained particles in an amount of 12.000 g was put into a reaction vessel equipped with a stirrer, temperature sensor and a cooling pipe along with 24,000 g of ion exchanged water having dissolved with 160 g of sodium n-dodecylsulfate.

In the reaction vessel 2,000 g of Latex MP-1 obtained in Preparation example MP-1, 3,000 g of Latex LP-1 obtained in Preparation example LP-1, and aqueous solution containing 400 g of magnesium chloride dissolved in 500 ml of ion exchanged water was added and the mixture was stirred for 30 minutes. Then a solution composed of 7000 ml of ion exchanged water and 1150 g of sodium chloride dissolved in the water was added to stop the salting out/fusion, and further the latex was heated and stirred for 2 hours at 85° C. as a ripening treatment. Thereafter, the latex was cooled to 30° C. at the rate of 8° C. per minute, and hydrochloric acid was added so as to adjust pH to 2.0, and stirring was stopped. The particles thus formed was filtered, repeatedly washed by ion exchanged water and dried by wind warmed at 400 C to obtain toner particle. Thus obtained toner particle was referred to "Toner particle 15Bk".

Comparative Production Example 1bk

A toner particle was prepared in the same manner as in Production example 2Bk except that the addition of Latexes MP-1 and LP-1 for forming the resin layer (shell) was omitted as shown in Table 1. Thus obtained toner particle was referred to 1bk.

Production Example 1Y

A dispersion of colorant particle having a weight average particle diameter of 105 nm was prepared by using 200 g of a dye C.I. Solvent Yellow 93 in place of the carbon black. The dispersion was referred to "Colorant dispersion Y". A toner particle was prepared in the same manner as in Production example 1Bk except that Colorant dispersion Y in place of Colorant dispersion Bk. Thus obtained toner particle was referred to "Toner particle 1Y".

Production Example 1M

A dispersion of colorant particle having a weight average particle diameter of 115 nm was prepared by using 200 g of a pigment C.I. Pigment Red 122 in place of the carbon black. The dispersion was referred to "Colorant dispersion M". A toner particle was prepared in the same manner as in Production example 1Bk except that Colorant dispersion M in place of Colorant dispersion Bk. Thus obtained toner particle was referred to "Toner particle 1M".

(Production Example 1C)

A dispersion of colorant particle having a weight average particle diameter of 110 nm was prepared by using 200 g of a pigment C.I. Pigment Blue 15:3 in place of the carbon black. The dispersion was referred to "Colorant dispersion C". A toner particle was prepared in the same manner as in Production example 1Bk except that Colorant dispersion C in place of Colorant dispersion Bk. Thus obtained toner particle was referred to "Toner particle 1C".

Comparative Production Example 1y

Colorant particle dispersion Y was prepared by using 200 g of the dye C.I. Solvent yellow 93 in place of the carbon black. A toner particle was prepared in the same manner as in Comparative production example 1bk except that Colorant dispersion Y was used in place of Colorant dispersion Bk. Thus obtained toner particle was referred to "Comparative toner particle 1y".

TABLE 1

| Toner | Toner particle A | | | | Toner particle B | | | The average spherical degree of the adhered particles (colored | Ripening step (Heating treatment) | |
|---|---|---|---|---|---|---|---|---|---|---|
| | | | | | | | | particles) at the adding time of Resin | Tempe-rature | Time |
| particle | Kind of latex | | | MwA | Kind of latex | | MwB | particle B | (° C.) | (hour) |
| 1Bk | HP-1 | MP-1 | LP-1 | 86,000 | MP-1 | LP-1 | 35,000 | 0.860 | 85° C. | 2 |
| 2Bk | HP-1 | MP-1 | LP-1 | 86,000 | MP-1 | LP-1 | 35,000 | 0.860 | 85° C. | 4 |
| 3Bk | HP-1 | MP-1 | LP-1 | 86,000 | MP-1 | LP-1 | 35,000 | 0.865 | 85° C. | 6 |
| 4Bk | HP-1 | MP-1 | LP-1 | 86,000 | MP-1 | LP-1 | 35,000 | 0.860 | 85° C. | 8 |
| 5Bk | HP-1 | MP-1 | LP-1 | 86,000 | MP-1 | LP-1 | 35,000 | 0.840 | 95° C. | 1 |
| 6Bk | HP-1 | MP-1 | LP-1 | 86,000 | MP-1 | LP-1 | 35,000 | 0.890 | 80° C. | 6 |
| 7Bk | HP-1 | MP-1 | LP-1 | 86,000 | MP-1 | LP-1 | 35,000 | 0.890 | 80° C. | 10 |
| 8Bk | HP-2 | MP-2 | LP-1 | 78,000 | MP-2 | LP-1 | 27,000 | 0.860 | 85° C. | 4 |
| 9Bk | HP-3 | MP-3 | LP-1 | 69,000 | MP-3 | LP-1 | 35,000 | 0.860 | 85° C. | 4 |
| 10Bk | HP-4 | MP-4 | LP-1 | 96,000 | MP-4 | LP-1 | 35,000 | 0.860 | 85° C. | 4 |
| 11Bk | HP-1 | MP-5 | LP-1 | 86,000 | MP-5 | LP-1 | 35,000 | 0.860 | 85° C. | 4 |
| 12Bk | HMLP-1 Combined particle | | | 89,000 | HMLP-1 Combined particle | | 89,000 | 0.860 | 85° C. | 4 |
| 14Bk | HP-1 | MP-5 | LP-1 | 86,000 | LP-1 | | 18,000 | 0.860 | 85° C. | 2 |
| 15Bk | Pulverized colored particles | | | 75,000 | LP-1 | MP-1 | 35,000 | 0.880 | 85° C. | 2 |
| Compara-tive 1bk | HP-1 | MP-5 | LP-1 | 86,000 | Not added | | | — | 85° C. | 4 |

Comparative Production Example 1m

Colorant particle dispersion M was prepared by using 200 g of-the pigment C.I. Pigment Red 122 in place of the carbon black. A toner particle was prepared in the same manner as in Comparative production example 1bk except that Colorant dispersion M was used in place of Colorant dispersion Bk. Thus obtained toner particle was referred to "Comparative toner particle 1m".

Comparative Production Example 1c

Colorant particle dispersion C was prepared by using 200 g of the pigment C.I. Pigment Blue 15:3 in place of the carbon black. A toner particle was prepared in the same manner as in Comparative production example 1bk except that Colorant dispersion C was used in place of Colorant dispersion Bk. Thus obtained toner particle was referred to "Comparative toner particle 1c".

The volume average particle diameter, the average spherical degree, the standard deviation of spherical degree, and the CV value of spherical degree of each of Toner particles 1Bk trough 12 Bk, Toner particle 1Y, Toner particle 1M, Toner particle 1C, Comparative toner particle 1bk, Comparative toner particle 1y, Comparative toner particle 1m, Comparative toner particle 1c were measured. Results of the measurement are shown in Table 2.

TABLE 2

| Toner particle | Volume average particle diameter (μm) | Spherical degree* (linear coefficient) Average | Standard deviation | CV value |
|---|---|---|---|---|
| 1Bk | 6.8 | 0.960 | 0.09 | 9.4% |
| 2Bk | 6.5 | 0.963 | 0.09 | 9.3% |
| 3Bk | 6.6 | 0.968 | 0.09 | 9.3% |
| 4Bk | 6.9 | 0.973 | 0.07 | 7.2% |
| 5Bk | 6.7 | 0.965 | 0.12 | 12.4% |
| 6Bk | 6.8 | 0.951 | 0.07 | 7.4% |
| 7Bk | 6.8 | 0.979 | 0.07 | 7.1% |
| 8Bk | 6.9 | 0.963 | 0.09 | 9.3% |
| 9Bk | 6.8 | 0.964 | 0.09 | 9.3% |
| 10Bk | 6.5 | 0.967 | 0.09 | 9.3% |
| 11Bk | 6.5 | 0.966 | 0.09 | 9.3% |
| 12Bk | 6.5 | 0.964 | 0.09 | 9.3% |
| 14Bk | 6.8 | 0.958 | 0.09 | 9.4% |
| 15Bk | 6.6 | 0.924 | 0.09 | 9.7% |
| 1Y | 6.7 | 0.963 | 0.09 | 9.3% |
| 1M | 6.6 | 0.963 | 0.08 | 8.3% |
| 1C | 6.7 | 0.963 | 0.09 | 9.3% |
| Comparative 1bk | 6.9 | 0.964 | 0.09 | 9.3% |
| Comparative 1y | 6.8 | 0.963 | 0.09 | 9.3% |
| Comparative 1m | 6.7 | 0.963 | 0.08 | 8.3% |
| Comparative 1c | 6.7 | 0.963 | 0.09 | 9.3% |

*: The spherical degree was measured by FPIA, manufactured by Toa Iyou Densi Co., Ltd., under the condition of a analyzed amount of the sample of 0.3 μl and a detected particle number of from 1,500 to 5,000.

Hydrophobized silica having a number average primary particle diameter of 12 nm and a hydrophobizing degree of 68 and hydrophobized titanium oxide having a number average primary particle diameter of 20 nm and a hydrophobizing degree of 68 were added so as each to be a content of 1.0% and 1.2% by weight respectively to each of Toner particles 1Bk trough 12 Bk, Toner particle 1Y, Toner particle 1M, Toner particle 1C, Comparative toner particle 1bk, Comparative toner particle 1y, Comparative toner particle 1m, Comparative toner particle 1c, and mixed by a Henschel mixer.

The shape and the particle diameter of these toner particles were not varied by the addition of the hydrophobized silica and titanium oxide.

Each of the Toner containing the hydrophobized silica and the hydrophobized titanium oxide was mixed with a silicone resin coated ferrite carried having a volume average particle diameter of 60 μm to prepare developers each having a toner content of 6% by weight. Thus prepared developers were each referred to Developers 1Bk through 12BK, Developer 1Y, Developer 1M, Developer 1C, Comparative developers 1bk through 12bk, Comparative developer 1Y, Comparative developer M and Comparative developer C corresponding to Toners particles 1Bk through 12BK, Toner particle 1Y, Toner particle 1M, Toner particle 1C, Comparative toner particles 1bk through 12bk, Comparative toner particle 1y, Comparative toner particle m and Comparative toner particle c used in each of the developer.

Examples 1 through 12 and Comparative Example 1

Practical using Test of the Black Toner

A practical copying test was performed by Digital Copying Machine 7065, manufactured by Konica Corp., in which 200,000 sheets of copying operation were performed with respect to each of Developers 1BK through 12Bk and Comparative developer 1bk, and an original image having a pixel ratio of 5% was copied on every 3 sheets. The density of the copied image and the fog were measured on the initial th copy and the 200,000$^{th}$ copy. The image density was measured at a copy of the solid black image by a densitometer RD-918, manufactured by Macbeth Co., Ltd., and represented by the absolute density. The fog density was measured at a copy of the solid white image by the densitometer RD-918 and represented by a relative density when the reflective density of the paper was set at 0.

A pressure contact type heat fixing device was used for fixing. The concrete constitution of the fixing apparatus is as follows.

A heating roller or upper roller was constituted by an aluminum cylinder including a heater at the central portion and having an internal diameter of 40 mm, a thickness of 1.0 mm and a width of 310 mm, and the surface of which was covered with a tube of tetrafluoroethylene-perfluoroalkyl vinyl ether copolymer (PFA) having a thickness of 120 μm. A pressure roller or lower roller was constituted by a cylindrical metal core of iron having an internal diameter of 40 mm and a thickness of 2.0 mm and the surface of which is covered with silicone rubber sponge having an Ascar hardness of 48 and a thickness of 2 mm. The heating roller and the pressure roller were contacted by applying the total loading of 150 N to form a nip of 5.8 mm width. The fixing apparatus was used and the line speed of printing was set at 250 mm/sec. For cleaning the fixing apparatus, silicone was supplied by a web immersed with silicone having a viscosity of 10 Pa s.

The temperature of the surface of the heating roller was controlled at 175° C. The coating amount of the silicone was 0.1 mg/A4.

Results of the evaluation are shown in Table 3.

TABLE 3

| | Developer | Image density | | Fog density | |
|---|---|---|---|---|---|
| | | Initial | After 200,000 sheets | Initial | After 200,000 sheets |
| Example 1 | Developer 1Bk | 1.42 | 1.38 | 0.001 | 0.002 |
| Example 2 | Developer 2Bk | 1.42 | 1.37 | 0.001 | 0.001 |
| Example 3 | Developer 3Bk | 1.42 | 1.35 | 0.001 | 0.002 |
| Example 4 | Developer 4Bk | 1.43 | 1.37 | 0.001 | 0.002 |
| Example 5 | Developer 5Bk | 1.42 | 1.29 | 0.001 | 0.004 |
| Example 6 | Developer 6Bk | 1.43 | 1.37 | 0.001 | 0.002 |
| Example 7 | Developer 7Bk | 1.42 | 1.37 | 0.001 | 0.001 |
| Example 8 | Developer 8Bk | 1.42 | 1.36 | 0.001 | 0.002 |
| Example 9 | Developer 9Bk | 1.42 | 1.37 | 0.001 | 0.002 |
| Example 10 | Developer 10Bk | 1.42 | 1.38 | 0.001 | 0.002 |
| Example 11 | Developer 11Bk | 1.42 | 1.37 | 0.001 | 0.003 |
| Example 12 | Developer 12Bk | 1.42 | 1.37 | 0.001 | 0.002 |
| Example 14 | Developer 14Bk | 1.43 | 1.41 | 0.001 | 0.001 |
| Example 15 | Developer 14Bk | 1.41 | 1.35 | 0.001 | 0.004 |
| Comparative example 1 | Comparative developer 1bk | 1.42 | 1.18 | 0.001 | 0.013 |

Example 13 and Comparative Example 2

Practical using Test of the Color Toner

A practical copying test was carried out in which 50,000 sheets of copies of a full color original having a pixel ratio of 25% under a condition of a temperature of 250 C and a relative humidity of 80% were continuously printed by a digital color copying machine Konica 3015 with respect to a combination of Developer 1Bk, Developer 1Y, Developer 1M and Developer 1C, and a combination of Comparative developer 1bk, Comparative developer 1y, Comparative developer 1m and Comparative developer 1c. The colors of solid images of secondary color (red, blue and green) formed on the first and 50,000$^{th}$ copies were measured by Macbeth Color-Eye 7000 and the color difference of each color was calculated by the CMC(2:1) color difference equation. Results are shown in Table 4.

When the color difference calculated by the CMC (2:1) equation was not more than 5, the variation of the color of the formed image was acceptable.

A pressure contact type heat fixing apparatus was used for fixing. The concrete constitution of the fixing apparatus is as follows.

A heating roller or upper roller was constituted by an aluminum cylinder including a heater at the central portion and having an internal diameter of 40 mm, a thickness of 1.0 mm and a width of 310 mm, the surface of which was covered with a tube of tetrafluoroethylene-perfluoroalkyl vinyl ether copolymer (PFA) having a thickness of 120 $\mu$m. A pressure roller or lower roller was constituted by a cylindrical metal core of iron having an internal diameter of 40 mm and a thickness of 2.0 mm and the surface of which is covered with silicone rubber sponge having an Ascar hardness of 48 and a thickness of 2 mm. The heating roller and the pressure roller were contacted by applying the total loading of 150 N to form a nip of 5.8 mm width. The fixing apparatus was used and the line speed of printing was set at 250 mm/sec. For cleaning the fixing apparatus, silicone was supplied by a web immersed with silicone having a viscosity of 10 Pa.s.

The temperature of the surface of the heating roller was controlled at 175° C. The coating amount of the silicone was 0.6 mg/A4.

TABLE 4

| | Combination of the developers | Color difference (difference between first and 50,000$^{th}$ copy) |
|---|---|---|
| Example 13 | Developer1Bk/1Y/1M/1C | 2 |
| Comparative example 2 | Comparative developer 1bk/1y/1m/1c | 7 |

(1) In the toner according to the invention, the amount of colorant at the surface of the toner, and the excellent charging ability and the developing ability of the toner is difficultly influenced by the using conditions.

(2) By the toner according to the invention, image density variation and fogging are difficultly occurred even when the toner is used for image formation under a high humid condition.

(3) By the toner according to the invention, color variation of the formed color image is difficultly occurred even when the toner is used for color image formation under a high humid condition.

What is claimed is:

1. A method of preparing toner comprising:

preparing colored particles (core particles) from a resin particle A and a colorant particle; and adhering and fusing a resin particle B onto surface of the core particles by salting-out/fusion-adhering to form a resin layer (shell).

2. The method of claim 1, wherein the colored particles (core particles) are formed by salting-out/fusion-adhering the resin particle A and the colorant particle.

3. The method of claim 2, wherein process for forming the colored particles (core particles) and a process of forming the resin layer (shell) on the colored particle are continuously performed.

4. The method of claim 1, wherein the colored particles (core particles) have an average spherical coefficient of from 0.850 to 0.950.

5. The method of claim 1, wherein weight average molecular weight of the resin particle A (MwA) is from 15,000 to 500,000, and the weight average molecular weight of the resin particle A and weight average molecular weight of the resin particle B (MwB) satisfy relation:

$$0.1 \leqq (MwA/MwB) \leqq 20/0.$$

6. The method of claim 2, wherein the resin particle B comprises a low molecular weight resin having a weight average molecular weight of from 5,000 to 20,000.

7. The method of claim 2, wherein at least one of the resin particle (A) and the resin particle (B) are formed by a multistep polymerization method.

8. The method of claim 6, wherein the resin particle B comprises a low molecular weight resin having a weight average molecular weight of from 5,000 to 20,000 in an amount of not less than 50% by weight.

9. The method of claim 2, wherein the colored particles (core particles) are formed by salting-out/fusion-adhering the resin particle A and the colorant particle in an aqueous medium.

10. The method of claim 2, wherein the colored particles (core particles) are formed by salting-out/fusion-adhering the resin particle A and the colorant particle at temperature of from Tg+10° C. to Tg+50° C.

11. The method of claim 2, wherein the toner is formed by salting-out/fusion-adhering the resin particles B on the colored particles (core particles) at temperature of from Tg +10° C. to Tg+50° C.

12. The method of claim 2, wherein the colored particles are formed by salting-out/fusion-adhering a resin particle A having high molecular weight, a resin particle A having middle molecular weight, a resin particle A having low molecular weight and the colorant particle.

13. The method of claim 2, wherein Tg of the resin particle A is from 45 to 70° C., and Tg of the resin particle B is from 100 to 140° C.

14. The method of claim 2, wherein an interval between time of addition of a salting-out agent to suspension in which the resin particle A and the colorant particle are dispersed, and time at which a temperature of suspension is reached to a temperature high than glass transition temperature Tg, a temperature at which the adherence become possible, is not more than 120 minutes.

15. The method of claim 1, wherein weight average molecular weight of the resin particle A (MwA) is from 15,000 to 500,000, and the weight average molecular weight of the resin particle A and weight average molecular weight of the resin particle B (MwB) satisfy relation:

$$0.1 \leqq (MwA/MwB) \leqq 20/0.$$

16. The method of claim 15, wherein the colored particles (core particles) are formed by salting-out/fusion-adhering the resin particle A and the colorant particle at temperature of from Tg+10° C. to Tg+50° C., and the toner is formed by salting-out/fusion-adhering the resin particles B on the colored particles (core particles) at temperature of from Tg+10° C. to Tg+50° C.

17. The method of claim 16, wherein Tg of the resin particle A is from 45 to 70° C., and Tg of the resin particle B is from 100 to 140° C.

18. The method of claim 17, wherein an interval between time of addition of a salting-out agent to suspension in which the resin particle A and the colorant particle colorant particle are dispersed, and time at which a temperature of suspension is reached to a temperature high than glass transition temperature Tg, a temperature at which the adherence become possible, is not more than 120 minutes.

19. The method of claim 15, wherein the resin particle B comprises a low molecular weight resin having a weight average molecular weight 5,000 to 20,000.

20. The method of claim 15, wherein at least one of the resin particle (A) and the resin particle (B) are formed by a multistep polymerization method.

* * * * *